United States Patent [19]

Mellin

[11] 4,414,925

[45] Nov. 15, 1983

[54] ENGINE COOLING FAN WITH SHEARABLE DRIVE TO ELIMINATE FAN OVERSPEED

[75] Inventor: Robert C. Mellin, Brighton, Mich.

[73] Assignee: General Motors Corporation, Detroit, Mich.

[21] Appl. No.: 370,417

[22] Filed: Apr. 21, 1982

[51] Int. Cl.[3] ..... F01P 5/14

[52] U.S. Cl. ..... 123/41.12; 123/41.15; 192/56 R; 192/104 F

[58] Field of Search ..... 123/41.01, 41.15, 41.12; 192/56 R, 58 A, 58 B, 85 F, 104 R, 104 F

[56] References Cited

U.S. PATENT DOCUMENTS

| | | | |
|---|---|---|---|
| 3,306,406 | 2/1967 | Poliseo | 192/104 R |
| 3,648,811 | 3/1972 | LaFlame | 192/58 B |
| 3,841,451 | 10/1974 | Saylor et al. | 192/58 B |

*Primary Examiner*—William A. Cuchlinski, Jr.
*Attorney, Agent, or Firm*—Charles R. White

[57] ABSTRACT

An engine cooling fan driven through a viscous clutch and having a mechanically shearable drive element into the powered input of the viscous clutch which shears at a predetermined low torque level to prevent fan damage due to viscous clutch lockup and limits fan speeds to a relatively low torque level.

4 Claims, 4 Drawing Figures

ENGINE COOLING FAN WITH SHEARABLE DRIVE TO ELIMINATE FAN OVERSPEED

This invention relates to cooling fans and more particularly an engine cooling fan having a shearable mechanical drive connection in the fan drive to terminate fan operation at a predetermined stress level to prevent fan overspeed.

Prior to the present invention various slipping clutch devices have been employed in the drive line to the engine cooling fan to effect fan drive when engine temperatures are elevated for engine cooling purposes and to disconnect the fan drive when such cooling is not required so that energy is conserved and vehicle operating efficiency is increased.

In a locked-up condition of the clutch, which is a failure mode, high centrifugal forces are developed in the fan at high engine speed. while such fans normally operate at relatively low speeds and stress levels they have to be designed for such overspeed operation and are accordingly robustly built to accommodate the stress levels which exceed by many times the normal operating stress level. With such design, the heavy duty fan blading and supporting structure add materially to the stress levels for driving the fan as well as to the overall weight of the vehicle.

In accordance with this invention fan speed during clutch lockup failure is limited to a readily manageable optimum speed so that the structural design of the fan is materially simplified as compared to prior engine cooling fans. In contrast to the prior engine cooling fans, this invention provides for a lighter weight fan which operates at a lower stress level. In the preferred embodiment of this invention the clutch input shaft is designed to shear at stress levels well below the stress level developed by prior art engine cooling fans operating under a locked-up clutch condition. The use of special shear surfaces in the clutch drive shaft of this invention effectively eliminates high speed fan operation during lockup failure of the clutch. With the shearing of the clutch drive shaft of this invention, the engine water pump would still be operative since the fan belt or other drive would still be driving the pump. This shearing would also call attention to the operator of the clutch input failure.

An object, feature and advantage of the present invention is to provide a new and improved fan drive which incorporates a shearable element in the drive line to the clutch that interrupts and terminates fan drive at a predetermined stress level so that a lighter weight fan can be employed in the system.

Another feature, object and advantage of the present invention is to provide an engine cooling fan drive having a viscous or other clutching device and further having a shearable element therein which terminates the drive to the clutch prior to the buildup of a high stress level in the fan otherwise occurring on clutch lockup and high engine speed conditions.

These and other features, objects and advantages of this invention will become more apparent from the following detailed description and drawings in which.

Figure 1:
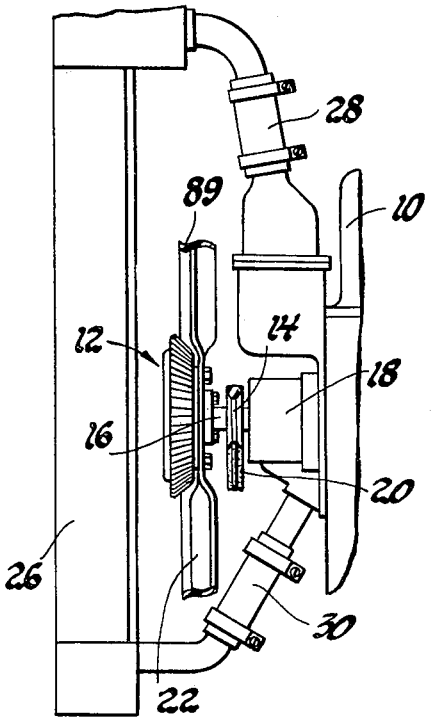
FIG. 1 is a side elevational view of a radiator and an engine having a viscous clutch and an associated engine cooling fan.

Turning now in greater detail to the drawing, FIG. 1 illustrates an engine 10 having a viscous fluid clutch 12 and a pulley 14 mounted on a rotatable drive shaft 16 extending from a conventional water pump 18. The pulley, rotatably driven by the engine through a V-belt 20 drive shaft 16 and thereby drives the water pump and a bladed engine cooling fan 22 secured to the output side of clutch 12. The clutch 12 and the cooling fan 22 are located between the engine 10 and a radiator 26. Conventional liquid conducting conduits and associated hoses 28, 30 hydraulically connect the radiator 26 and the engine 10 so that cooling fluid circulating from the engine is cooled as air is drawn by the fan through the core of the radiator 26.

Figure 2:
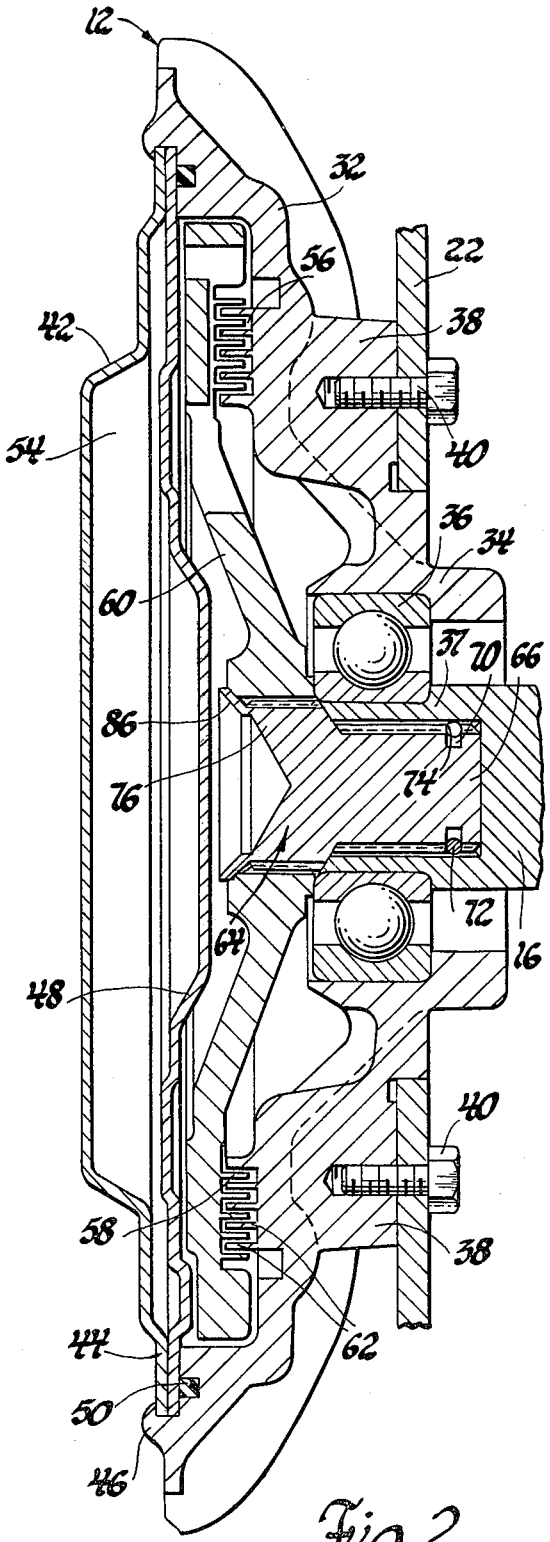
FIG. 2 is an enlarged fragmentary cross-sectional view of the viscous fluid clutch and fan of FIG. 1.

Referring now to FIG. 2, the fluid clutch 12 includes a dish-like clutch output member 32 having a centralized hub 34. A bearing 36, disposed on a shoulder end portion 37 of the drive shaft 16, is received in hub 34 and rotatably mounts the clutch output member 32 on the drive shaft 16. The clutch output member 32 is further formed with a plurality of bosses 38 which extend radially from hub 34 to which the bladed fan 22 is attached by threaded fasteners 40.

A sheet metal cover 42 is mounted to the front of the clutch output member 32 and cooperates therewith to enclose the components of the viscous clutch of this invention to drivingly connect and disconnect the fan 22 with respect to the drive shaft 16. The cover 42 is a thin wall member in the general configuration of a pie pan which has radial flange 44 peripherally secured to the clutch output member 32 by an annular offset or spun over portion 46 of the output member 32. Disposed immediately behind cover 42 is a dish-like annular pump plate 48 whose diameter is equal to that of the cover 42 and is drivingly secured to the output member 32, being trapped behind the flange of the cover and the upset portion 46. Annular seal 50 interposed between the pump plate 48 and the output member 32 prevents fluid leakage from the viscous clutch 12. The pump plate 48 and front cover 42 form an annular reservoir 54 which contains a quantity of viscous silicone clutching fluid that under certain operating conditions is supplied into an annular fluid shear zone 56 formed between the interleaved annular ridges 58 of a rotatable clutch input drive plate 60 and the corresponding annular ridges 62 formed on the inner surface of the clutch output plate 32. Fluid sheared in this zone transmits input torque from the input clutch plate 60 to provide for the hydraulic drive of the clutch output plate 30 and the bladed fan 22 attached thereto.

Suitable inlet and outlet passages controlled by a bimetal such as disclosed in U.S. Pat. No. 3,841,451 to Saylor et al issued Oct. 15, 1974 for "Viscous Fluid Clutch", herein incorporated by reference, are provided for the pump plate 48 to control the supply and exhaust of viscous clutching fluid into the shear zone. When engine cooling by operation of fan 22 is not required viscous fluid is pumped from the shear zone at a rate exceeding supply so that clutch slippage is maximized and the fan freewheels or runs at a reduced speed. As engine operating temperatures increase and fan cooling is required the controls on the pump plate increase the supply of viscous fluid into the shear zone. As the shear zone progressively gains viscous fluid, clutch slippage is progressively reduced so that the fan speeds increase to pump increasing quantities of cooling air through the radiator. In a lockup condition, which is a failure mode, the input and output clutch plates rotate at the same speed.

Figure 4:
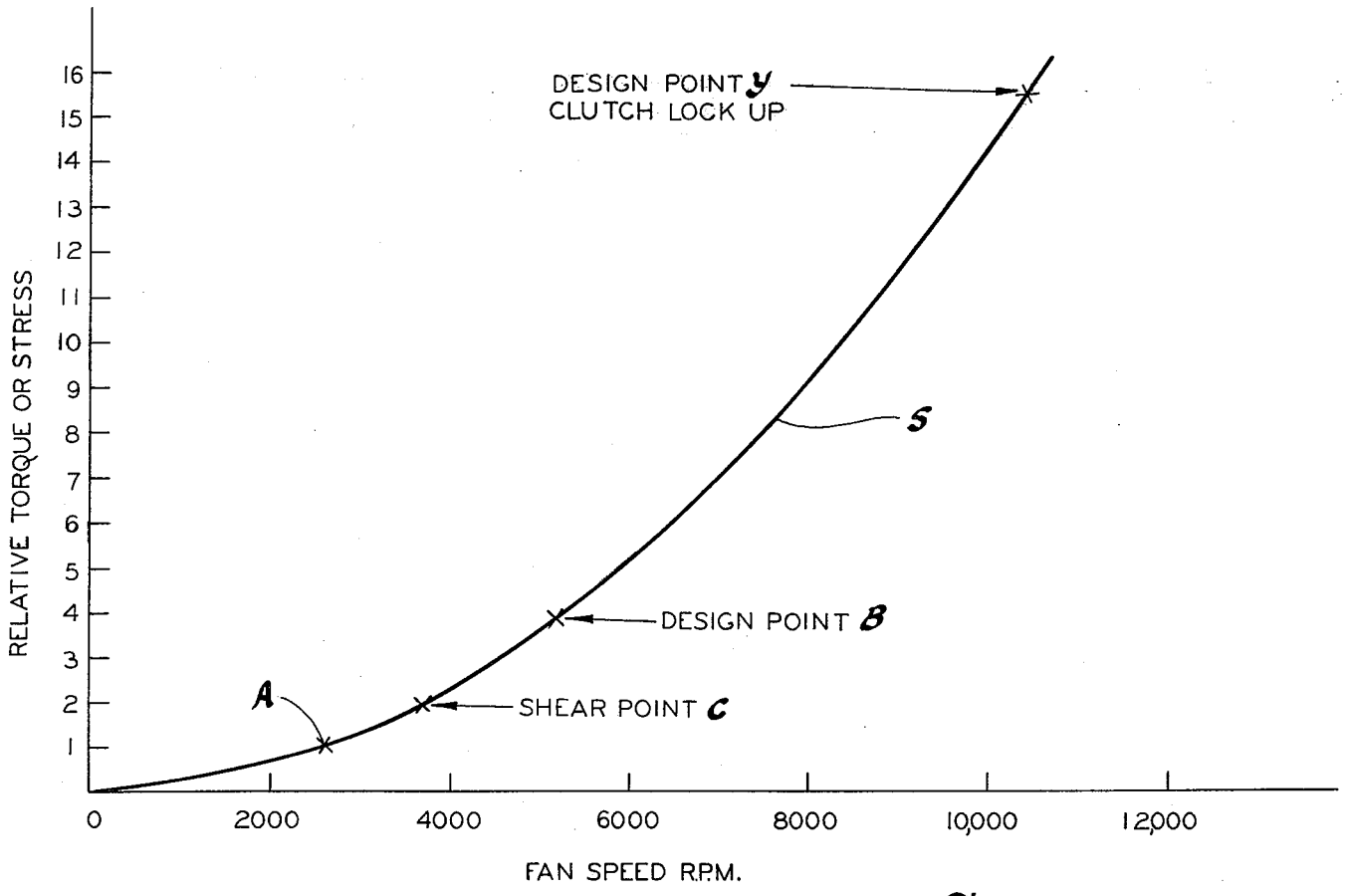
FIG. 4 is a curve comparing operation of this invention and prior art constructions.

Prior to this invention high centrifugal forces could be developed by a fan under such lockup conditions as the engine accelerated to its maximum speed such as illustrated by curve S in FIG. 4. To ensure the integrity and proper operation of the fan at all operating speeds including high engine speeds, which could result in fan speeds as high as 10,200 rpm, shown in FIG. 4, the fan was designed and built to operate up to point Y on the curve to withstand the high torque which, as shown on the ordinate, is 16 times the normal fan stress. Such high speed fans were made from steel or other materials. This resulted in a heavy and bulky fan which required special bearings, and precludes use of plastic molded fan with annular shrouding element 89 secured to the tips of the fan blades which improves fan efficiency and reduces noise as disclosed in U.S. Pat. No. 4,181,172 to Longhouse issued Jan. 1, 1980 for "Fan Shroud Arrangement", herein incorporated by reference. Furthermore, such fans added to the overall vehicle weight and detracted from vehicle operating economy.

Figure 3:
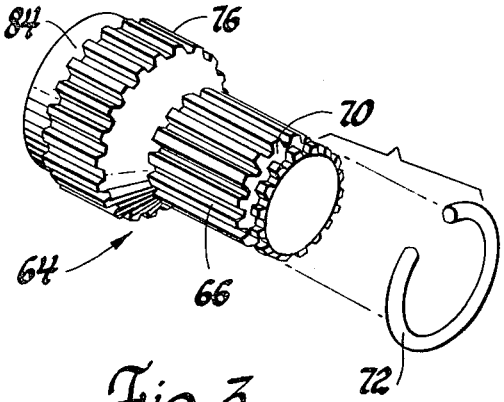
FIG. 3 is an isomeric view of a shearable drive element used in the fan drive of FIGS. 1 and 2.

In contrast to the heavy duty prior constructions, this invention simplifies fan design and allows the effective use of lighter weight and a wide variety of materials from fan manufacture. In the preferred embodiment of this invention a special shearable or frangible drive plug or element 64 is interposed between the drive shaft 16 and the clutch drive plate 60. As best shown in FIGS. 2 and 3, this shearable drive element may be made of a suitable low carbon steel or a suitable nonferrous metal, has a shank portion 66 externally splined to intermesh with the internal splines of the shouldered end portion 37 of the shaft 16. An annular groove 70 formed in the shank 66 and near the free end thereof receives a snap-ring 72 which is adapted to snap-fit into a groove 74 provided in the internal splines of the shouldered end portion 37 of shaft 16 to axially maintain the shearable drive element in the assembled position shown in FIG. 2. The clutch drive plate 60 is held in position on the head 76 of the shearable drive element by spinning or coining the cylindrical outer end 84 of the drive element radially outwardly as shown at 86 in FIG. 2

With this construction the design point Y required in some prior fan drives can be reduced to point B on the curve S with the fan operating at a maximum of 5,000 rpm and at a torque or stress level of 4 as compared to a normal stress level of 1 (point A). This exceeds the design shear point of the drive element 64 which in the preferred embodiment of this invention occurs at point C which is approximately 2 times normal stress level which occurs at a fan speed of about 3,800 rpm. Point A is the maximum operating speed expected in normal usage of this invention. In the event that the fan speeds toward its new design point the element 64 would shear to interrupt the drive at a relatively low torque or stress level and well below the design point of this fan. Accordingly, the fan of this invention would not have to be designed and built with special considerations for such high speed operation and is preferably built with lighter weight and a wider range of materials. Since the fan of this invention cannot reach a high stress level it can be provided with additional construction such as the annular shrouding element 89 secured to the tips of the fan blades to improve fan efficiency and control noise such as disclosed in U.S. Pat. No. 4,181,172to Longhouse, referenced above. In the event that the drive element shears the water pump still operates and engine cooling is effected through water pump operation until the clutch 12 is removed and repaired with replacement of a new clutch unit or a new shearable drive element in place of the fractured element 64.

While the shearable drive element of this invention is preferably a one-piece unit configured to shear on a specific load the element could be a multipart member and have varying configurations to tailor the cutoff speed and torque of the fan so that action would be adjusted from that described in connection with the preferred embodiment.

While a preferred embodiment has been shown and described for illustrating this invention, other embodiments employing the concept and ideas of this invention may be adapted by those skilled in the art such as falls within the scope of the appended claims.

The embodiments of the invention in which an exclusive property or privilege is claimed are defined as follows:

1. A rotatable fan and clutch assembly for cooling an internal combustion engine having a rotatable output for powering said fan, a clutch having rotatable clutch input means and rotatable output means driven by said clutch input means, a bladed fan operatively connected to said clutch output means, and frangible metallic drive plug means drivingly connecting said output of said engine to said clutch input means to break on attainment of a predetermined fan speed to terminate the rotational input into said clutch input means and thereby the drive of said fan for limiting the centrifugal forces developed by said fan while effecting the cooling of said engine.

2. A rotatable fan and clutch assembly for cooling an internal combustion engine having a rotatable output for driving said fan, a viscous clutch having a rotatable input drive plate and having a rotatable output plate driven by fluid sheared in response to relative rotation of said input drive plate and said output plate, a multi-bladed fan operatively connected to said output plate and frangible metallic drive element means splined to and drivingly extending from said output into said clutch and drivingly connected to said clutch input drive plate to mechanically shear and break on the attainment of a predetermined fan speed and torque level to terminate a rotational input into the clutch input plate to thereby terminate the power drive of said fan and to limit the centrifugal forces developed by said fan while effecting the cooling of said engine.

3. A fan assembly for inducing air flow through a radiator in which vehicle engine coolant is circulated comprising a power shaft adapted to be rotatably driven by a vehicle engine up to a predetermined angular velocity, first rotatable clutch means adapted to be rotatably driven by said engine through said power shaft, a housing for said clutch means rotatably supported by said shaft, said housing having second clutch means on the interior thereof spaced from said first clutch means to provide a fluid shear zone therebetween, fan blade means secured to said housing and extending generally radially outwardly therefrom, a cover plate attached to said housing to form a fluid chamber therewith, a pump plate secured to said housing between said cover plate and said first clutch means to thereby form a hydraulic fluid reservoir controlling the flow of fluid between said reservoir and said shear zone to thereby control the transmission of torque through said clutch, and frangible mechanical shear means drivingly connected to power shaft and drivingly mounting said first clutch means for interrupting the drive from said power shaft to said first fluid clutch means at a predetermined torque level to thereby limit the centrifugal load on said fan blades as said power shaft accelerates to said predetermined angular velocity.

4. A fan assembly for inducing air flow through a radiator in which vehicle engine coolant is circulated comprising a power shaft adapted to be rotatably driven by a vehicle engine up to a predetermined angular velocity, first rotatable clutch means adapted to be rotatably driven by said engine through said power shaft, a housing for said clutch means rotatably supported by said shaft, said housing having second clutch means on the interior thereof spaced from said first clutch means to provide a fluid shear zone therebetween, multi-bladed fan means secured to said housing, a cover plate attached to said housing to form a fluid chamber therewith, a pump plate secured to said housing between said cover plate and said first clutch means to thereby form a hydraulic fluid reservoir, said pump plate means for controlling the flow of fluid from said resevoir into said shear zone to thereby control the transmission of torque through said clutch, and frangible mechanical drive element means drivingly connected to said power shaft and to said first clutch means for interrupting the drive from said power shaft to said first fluid clutch means in response to the attainment of a predetermined angular velocity of said fan to thereby prevent damage of said fan blades as said power shaft accelerates to said predetermined angular velocity.

* * * * *